United States Patent [19]

Gawron et al.

[11] Patent Number: 4,630,023

[45] Date of Patent: Dec. 16, 1986

[54] ELECTRICAL FUSE

[75] Inventors: Klaus Gawron, Aachen, Fed. Rep. of Germany; Simon Jonker, Ba Eindhoven, Netherlands; Johann Schröder, Aachen, Fed. Rep. of Germany; Henk V. De Weerdt, Ah Sittard, Netherlands

[73] Assignee: U.S. Philips Corporation, New York, N.Y.

[21] Appl. No.: 743,242

[22] Filed: Jun. 11, 1985

[30] Foreign Application Priority Data

Jun. 16, 1984 [DE] Fed. Rep. of Germany ..... 3422528

[51] Int. Cl.[4] ..... H01H 37/76

[52] U.S. Cl. ..... 337/407; 337/401; 337/416

[58] Field of Search ..... 337/401, 416, 407, 408, 337/409

[56] References Cited

U.S. PATENT DOCUMENTS 4,344,061 8/1982 Niwa ..... 337/409

*Primary Examiner*—Harold Broome

*Attorney, Agent, or Firm*—Norman N. Spain

[57] ABSTRACT

In an electrical fuse which serves for temperature limitation, which comprises a closed housing (1) and in which a spring mechanism (2,3,4) interrupts an electrical contact as soon as a fuse body (6) serving as a support for the spring mechanism liquefies and relieves the spring mechanism, the fuse body mainly consists of a saturated dicarboxylic acid containing 4 to 14 carbon atoms.

6 Claims, 2 Drawing Figures

ELECTRICAL FUSE

BACKGROUND OF THE INVENTION

The invention relates to an electrical fuse comprising a closed housing, in which a spring mechanism interrupts an electrical contact as soon as a fuse body serving as a support for the spring mechanism and mainly consisting of an organic material liquefies and relieves the spring mechanism.

Such a fuse is known from U.S. Pat. No. 2,934,628.

Essentially there are two kinds of fuses: those of the first kind serve for current limitation and those of the other kind serve for temperature limitation. In the first kind, a fuse body is heated by the electrical current itself so strongly that it melts at a given maximum permissible current intensity and interrupts the electrical contact in an irreversible manner. However, the invention solely relates to the second kind of fuses, in which the interruption of the contact takes place not by the current, but by external heating at a given maximum permissible temperature. Such fuses are increasingly incorporated in electrical apparatus in order to protect them from overheating and to switch them off in an irreversible manner when a given temperature is exceeded. The switching-off temperature is determined by the melting temperature of the fuse body.

In order that an absolutely reliable operation of the fuses can be guaranteed even for long operating times, the following particular requirements have to be imposed on the fuse body as the actual switching element:

Suitable materials must have a melting point associated with the relevant switching-off temperature. In order that the fuses act rapidly, they should operate as far as possible at an accurately defined melting point and not in a melting range. Therefore, the waxes mentioned in U.S. Pat. No. 2,934,628 are not suitable as material for the fuse body.

Upon melting the fuse bodies have to flow out as as easily and rapidly as possible in order to enable the springs within the fuse to open the contact.

During the whole operating time, the fuse bodies are not only subjected to a given spring stress, but are also subjected to a thermal variation load. They have to be capable of withstanding the spring force at temperatures which from time to time lie just below the relevant melting point. Of course the shape of the fuse bodies (cylinder, hollow cylinder, sphere etc.) and the manufacturing method strongly influence the pressure strength that can be attained. At any rate it has to be ensured that the fuse bodies are capable of withstanding a multiple of the spring stress occuring during operation and do not undergo critical length or shape variations during the required operating time.

For a reliable operation of the fuse bodies, during the manufacture different tolerance limits have to be taken into account. Consequently, materials should not be used which upon heating cause irregular or irreversible length variations and which exhibit, for example, below the operating temperature, a phase variation and a volume variation connected therewith (for example the $\alpha KNO_3 \rightarrow \beta KNO_3$, phase variation at 129° C.).

With respect to the corrosion within the fuses, it should be ensured that the materials used for the fuse bodies are not allowed at any rate to attack the surfaces of the contacts or of the housing. Since the fuses are generally sealed in a vacuum-tight manner during the manufacture, with the use of hygroscopic materials no problems are to be expected during operation, because moisture can be kept remote from the fuses. However, additional measures can become necessary for the production process.

In the relevant fields of use, temperatures may be reached at which already clearly observable vapour pressures of the material of the fuse bodies can occur. This especially applies to most of the alkaline materials. Due to inhomogeneous temperatures of the fuse, mass transports of fuse body materials through the gaseous phase can thus take place and the operation of the electrical contacts can be adversely affected. Therefore, a comparatively low vapour pressure at operating temperatures is of major importance when choosing the materials for the fuse body.

Finally, the materials for the fuse bodies have to be available in the largest possible quantities and at the lowest possible cost and it has to be possible to process them readily by casting or moulding to form stable mouldings.

BRIEF SUMMARY OF THE INVENTION

The invention has for its object to provide stable fuse bodies which are accurate in shape and which satisfy all the aforementioned quality requirements.

According to the invention, this object is achieved when the fuse body mainly consists of a saturated dicarboxylic acid containing 4 to 14 carbon atoms.

Particularly suitable dicarboxylic acids are: adipinic acid ($HO_2C[CH_2]_4CO_2H$, melting point 153° C.), pimelinic acid ($HO_2C[CH_2]_5CO_2H$, melting point 106° C.), suberic acid ($HO_2C[CH_2]_6CO_2H$, melting point 140° C.), heptanodicarboxylic acid ($HO_2C[CH_2]_7CO_2H$, melting point 106° C.), sebacinic acid ($HO_2C[CH_2]_8CO_2H$, melting point 134° C.).

With respect to most other organic compounds, the dicarboxylic acids are distinguished by a high chemical stability and a particularly low vapour pressure below the melting point.

Moreover, their melting points between 100° and 150° C. are particularly favourable because in many practical cases a temperature limitation in this range is required. Thus, for example, in order to avoid a dangerous increase in pressure, a limitation in this temperature range is necessary because the vapour pressure of water and of aqueous solutions as well as of many conventional organic materials at these temperatures increases above atmosphere pressure. Moreover, many materials, for example most of the synthetic materials, will soften, melt or degrade.

On the other hand, glasses or inorganic salts, which would be generally considered as fuse materials, are not suitable for this temperature range because their melting points are too high.

DETAILED DESCRIPTION OF THE INVENTION

Figure 1:
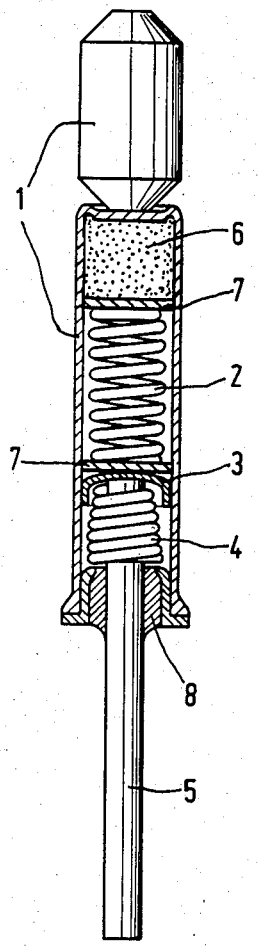
FIG. 1 is a sectional view of a fuse in the normal operating condition.

The fuse bodies can be very readily manufactured by casting the molten materials into corresponding casting dies of metal, graphite or other materials suitable for casting dies.

Furthermore, the fuse bodies can be very readily manufactured by a method in which pulverized materials are moulded into the desired shape at a moulding pressure of about 5000 to 10.000 bar, more particularly between 1000 and 3000 bar.

In order to guarantee that the dimensions of the fuse bodies are defined within narrow tolerance limits, it is efficacious to feed an accurately defined quantity of powdered material into the mould. In series production, these quantities are to be held within the same narrow tolerance limits for all mouldings. It may then occur that the powder particles more or less adhere to each other as clusters of widely different size. The materials can then be distributed only with great difficulty by pouring and shaking in uniformly metered quantities over several moulds and a reproducible mass production of similar mouldings becomes impossible in this manner.

A suitable flowability of the powders can be obtained for this purpose by known granulation methods (Römpps Chemie Lexikon, 7th ed., Vol. 2, 1973, p. 1340). In order to manufacture a powder for forming fuse bodies, which does not adhere but can be readily introduced into moulds by a simple pouring and can be metered in a reproducible manner and which moreover can be pressed to form solid fuse bodies, which are stable as to shape and length up to operating temperatures immediately below the melting an switching point, it is also efficacious, however, to add to the pulverized pure fuse material a fine-grained oxidic or ceramic material in quantities of from 10 to 75% by weight. Examples for such materials are aluminum oxide ($Al_2O_3$, corundum) and zirconium oxide having grain sizes between 0.25 and 0.05 μm.

The operation and the essential construction of the fuse according to the invention will be apparent from an embodiment shown in the drawing, in which:

FIG. 1 is a sectional view of a fuse in the normal operating condition, and

Figure 2:
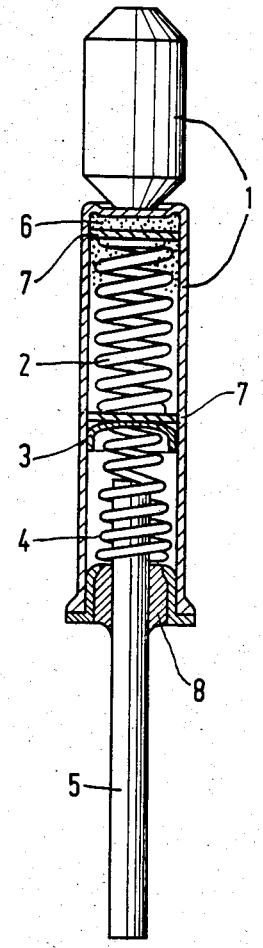
FIG. 2 is a sectional view of a fuse after thermal overload.

FIG. 2 is a sectional view of a fuse after thermal overload.

The fuse comprises a closed metallic housing 1, in which a spring mechanism consisting of a cylindrical spring 2, a star-shaped spring 3 and a conical spring 4 interrupts the electrical contact between a current supply lead 5 and the star-shaped spring 3 as soon as a fuse body 6 serving as a support liquefies and relieves the cylindrical spring 2. There are arranged between the fuse body 6 and the cylindrical spring 2 as well as between the cylindrical spring 2 and the star-shaped spring 3 supporting plates 7 which ensure a uniform distribution of the spring pressure. At the area of the wall of the housing 1 the current supply lead 5 is surrounded by a sealing and insulating body 8.

When the fuse body melts, the spring mechanism is actuated as follows: The spring 2 is relieved, as a result of which the conical spring 4 lifts the star-shaped spring 3 off the current supply lead 5 and thus interrupts the electrical contact. In FIG. 1 the contact is closed and in FIG. 2 the contact is open and the fuse body is molten. The favourable flow property of the pulverized fuse materials attained by the addition of fine-grained oxidic or ceramic material will be apparent from the following tables, in which the times are indicated which are required until 3.0 $cm^3$ of the loose powder particles of fuse material, has passed through, the opening of an hourglass, formed from a glass funnel having an opening of 1.5 mm diameter and which is of 20 mm length.

The powders and powder mixtures are preferably fed before use through a fine-mesh sieve so that it is excluded that any larger crystals or clusters present as impurities can adversely affect the measurement or in practice also the metered filling of the moulds.

TABLE I

| Fuse material | Granulation addition | Flowing time (sec) |
|---|---|---|
| pure Sebacinic acid | ./. | does not flow |
| " | $+Al_2O_3$ 1:1 | 12 |
| " | $+Al_2O_3$ 1:2 | 11 |
| pure Suberic acid | ./. | does not flow |
| " | $Al_2O_3$ 1:1 | 14 |

TABLE II

| Fuse material | Granulation addition | Grain size mm O | Mixing ratio Gew.-T. | Flowing time (sec) |
|---|---|---|---|---|
| pure Sebacinic acid | ./. | | ./. | does not flow |
| pure Sebacinic acid | $Zr_2O_3$ | <0.250 | 1:1 | 21 |
| pure Sebacinic acid | " | " | 1:1.5 | 19 |
| pure Sebacinic acid | " | 0.250–0.125 | 1:1 | 25 |
| pure Sebacinic acid | " | " | 1:2 | 25 |
| pure Sebacinic acid | " | <0.125 | 1:1 | 18 |
| pure Sebacinic acid | " | " | 1:2 | 16 |
| pure Sebacinic acid | " | 0.125–0.063 | 1:1 | 19 |
| pure Sebacinic acid | " | " | 1:2 | 16 |

The flowability of the $Al_2O_3$ mixtures is consequently very satisfactory, while the materials without addition flow only very poorly or do not flow at all.

What is claimed is:

1. An electric fuse comprising a closed housing enclosing a liquifiable fuse body and a spring mechanism, said spring mechanism supporting said fuse body and serving to interrupt an electric contact upon liquification of said fuse body, characterized in that said fuse body comprises a saturated dicarboxylic acid selected from the group consisting of adipinic acid, pimelinic acid, suberic acid, heptanodicarboxylic acid and sebacinic acid.

2. A fuse as claimed in claim 1, characterized in that the fuse body is manufactured by casting the molten materials into corresponding moulds.

3. A fuse as claimed in claim 1, characterized in that the fuse body contains a fine-grained oxidic or ceramic material in quantities of from 10 to 75% by weight.

4. A fuse as claimed in claim 3, characterized in that the fuse body contains aluminum oxide or zirconium oxide having grain sizes between 0.25 and 0.05 μm.

5. A fuse as claimed in claim 1, characterized in that the fuse body is manufactured by casting the molten materials into corresponding molds.

6. A fuse as claimed in claim 1, characterized in that the fuse body contains a fine-grained oxidic or ceramic material in quantities of from 10 to 75% by weight.

* * * * *